US005951722A

United States Patent [19]

Sanders et al.

[11] Patent Number: 5,951,722

[45] Date of Patent: Sep. 14, 1999

[54] CATALYZED LOWER ALCOHOLS-WATER BASED FUELS

[76] Inventors: James K. Sanders, 9608 Toledo, Lubbock, Tex. 79424; Richard W. Tock, 4916 76th St., Lubbock, Tex. 79424-2147

[21] Appl. No.: 08/960,482

[22] Filed: Oct. 29, 1997

[51] Int. Cl.[6] ..... C10L 1/12

[52] U.S. Cl. ..... 44/354; 44/357; 44/451; 44/452; 44/457

[58] Field of Search ..... 44/354, 357, 451, 44/452, 457

[56] References Cited

U.S. PATENT DOCUMENTS 2,429,707 10/1947 Catalano ..... 44/451
4,255,158 3/1981 King ..... 44/451
5,183,476 2/1993 Carlsson et al. ..... 44/451
5,266,082 11/1993 Sanders ..... 44/354

*Primary Examiner*—Jerry D. Johnson

[57] ABSTRACT

Catalyzed lower alcohol-water based fuels are presented which are suitable for use in internal combustion engines, said fuels flowing from renewable carbon resources and providing a clean burn which is environmentally safe as compared to conventional fossil fuels. The internal combustion engines can be run on alcohol fuels containing significant amounts of water and a catalyst comprised of the oxides of selected Group IIA and Group IIB elements; and even though the energy densities of the catalyzed lower alcohol-water based fuels are less than gasoline, the catalyzed lower alcohols-water based fuels provide combustion which is more complete which potentially renders these fuels much more environmentally friendly.

18 Claims, 6 Drawing Sheets

Correlation of Actual Fuel Ratio Content to the Theoretical Fuel Ratio Based on Unleaded Gasoline (86 Octane)

CATALYZED LOWER ALCOHOLS-WATER BASED FUELS

FIELD OF THE INVENTION

The present invention is related to a novel internal combustion engine fuel which flows from renewable carbon resources and is environmentally safe as compared to conventional fossil fuels. In another aspect, the inventive fuel compositions are comprised of catalyzed lower alcohols-water based fuels which burn with environmentally acceptable emission and are suitable for internal combustion engines. In yet another aspect the inventive fuel compositions are based on catalyzed alcohols, the catalysts being in the forms of oxides of selected Group IIA and Group IIB elements of the periodic table.

DESCRIPTION OF RELATED ART

The steadily increasing demand for liquid fuels, made for the internal combustion engine and the decreasing supply of petroleum and crude oil has forced researchers to look to alternative fuels in order to fulfill the future demands for liquid fuels. Events for the last two decades throughout the world including a shortage of petroleum crude oil, the sharp increases in the costs of oil and gasoline motor fuels as well as the politic instability of crude oil producing countries has demonstrated the vulnerability of the present sources of liquid fuel. Even if these supplies and economic risks were acceptable, it is clear the worldwide product of petroleum products at projected levels can neither keep pace with the increase and demand nor continue indefinitely. It is becoming increasingly evident that the time will soon come when there will have to be a transition to resources which are more plentiful and preferably renewable as well as other energy sources other than combustion sources.

Renewable carbon resources are available and can be utilized as alcohol fuels. Alcohols seem to be and are a promising alternative to petroleum-based fuels in general use today. For example alcohols such as methanol and ethanol have been substituted for conventional petroleum derived diesel fuels for burning in diesel engines, when used in combinations with ignition accelerators such as ethyl nitrate and nitrite. Reportedly the addition of alkyl nitrate or nitrite to the alcohol reaches a level of auto ignition sufficient to permit the operation of diesel engines on alcohol.

More commonly various methanol and ethanol additives have been utilized in cooperation with petroleum-based fuels. Ethanol is an especially good alternative fuel in countries with intense cultivation of sugar cane, mandioca and other raw materials of vegetable origin, adequate for the production of ethanol. Both methanol and ethanol as well as other lower aliphatic alcohols are good alternatives to petroleum-based fuels. These alcohols can be stored transported and distributed using traditional systems in a tradition manner. Few changes to the present day engine are necessary for the adaptation to alcohols for the requirements of the internal combustion engine. As these fuels can be used in existing systems with limited modifications, the total investment necessitated by a changeover is minimized.

Presently oxygenates such as alcohols as a fuel for internal combustion engines have presented certain disadvantages. One of the most obvious is creation of corrosion problems both in the logistical chain and in the vehicle itself. Further it is known that ethanol has a tendency to pick up water from the environment. That is, it is hygroscopic. When exposed to ethanol containing water, many metals and alloys which make up the vehicle fuel distribution system and the vehicle's engine can corrode. These problems have been met with use of anhydrous and substantially anhydrous ethanol. However if the fuel mixture is stored for too long of period of time before use, the anhydrous ethanol will pick up water from the environment and become hydrous or wet ethanol.

Even though ethanol has been recognized as a possible liquid fuel alternative which can be available in significant quantities for the remainder of this century the economics of ethanol fuel for internal combustion has only recently become possible. This change in economics due to the rising cost of petroleum products has had a continued review of ethanol based or lower alcohol based alternative fuel sources because of their approaching economic competitiveness. It would be appreciated that the blended ethanol-based fuel or ethanols blended with other lower alcohols will not only be economically competitive in the existing price market of petroleum fuels but may even be produced at a cost below that of existing petroleum fuels presently and in the future.

Alcohols, specifically ethanol as a component in conventional petroleum fuels because of higher thermal efficiency than ordinary petroleum motor fuel is attractive particularly when burned in the internal combustion engine. Ordinary petroleum fuels convert only a small portion of the energy of the fuel into use for work. However, continuing progress in motor design and efficiency burn within the cylinder has improved the utilization of ordinary petroleum motor fuels. In addition these ordinary petroleum motor fuels have been supplemented with oxygenates such as ethanol and other blended compounds to further fuels having slightly greater thermal efficiency than straight petroleum fuel. Nevertheless, still other studies using engines designed to run on conventional petroleum fuels have shown that in terms of power, 100% ethanol or near 100% lower alcohol fuel blends falls short delivering the power of ordinary petroleum fuels.

The fuel researchers have generally limited their use of ethanol to that of an additive in petroleum fuels. It has been thought necessary to significantly modify conventional engines in order to use a fuel which is predominately ethanol or a lower alcohol blend. In addition there are several other problems which have lead those skilled in the art away from using ethanol as a primary component in a substitute liquid fuel in conventional engines. Such problems which have heretofore not been solved by those of the art have been taken into account in the blended ethanol based liquid fuel of the present invention which can be used as a substitute for ordinary petroleum fuels and unmodified internal combustion engines.

Exhaust emissions from internal combustion engines' present serious environmental concerns. Motor vehicle exhaust emissions, in particular, present a serious unchecked problem in many large cities. These emissions not only contribute to the smog and pollution problems resulting in the silent continual destruction of the ozone layer, but may also cause long term health effects due to their potential toxicity. In an attempt to regulate the levels of potentially harmful pollutants in the environment, the Environmental Protection Agency prorogated emission standards setting forth acceptable levels of carbon monoxide, nitrogen oxides, particulate matter and hydrocarbons in the exhaust emissions of various classes of motor vehicles.

The hydrocarbon content of vehicle emissions is indicative of the fuel burning efficiency in the engine. The higher the percentage of the hydrocarbon (HC) emissions, the lower the levels of efficient burn. The carbon dioxide ($CO_2$) content of the emissions reflects the combustion efficiency and catalatic action of the engine and fuel components. The higher the carbon dioxide contents the more efficient the combustive process. The carbon monoxide (CO) content of the emissions is also indicative of the level of combustion in the engine chamber. A high percentage of carbon monoxide in motor vehicle emissions, often caused by lean air to fuel ratio, is indicative of incomplete combustion in the engine chamber. A high molecular oxygen ($O_2$) content in the emissions can mean a lean fuel to air ratio or fouled plugs. Ideally motor exhaust emissions contain low percentages of hydrocarbons, carbon monoxide and molecular oxygen as well as a high percentage of carbon dioxide.

A continuing need is upon the world energy users particularly for the internal combustion engine for finding renewable carbon resource which when properly burned or blended or both provide a friendly environmental emission system. In addition these renewable carbon sources must be competitive in pricing and economics in order for the general public to utilize the renewable carbon source fuels. As the petroleum base gasoline/oil fuels diminish due to availability in worldwide production, renewable carbon sources must be fine tuned and brought to bear in order to fill the desirable environmental emission standards as well as provide the consuming public with an alternative fuel source.

SUMMARY OF THE INVENTION

This invention is directed to an internal combustion engine fuel which flows from renewable carbon resources and is environmentally safe as compared to conventional fossil fuels. A fuel composition of lower alcohols and water containing effective amounts of catalysts, the catalysts being forms of oxides of selected Group IIA and Group IIB metals which provide an environmentally friendly internal combustion engine fuel having an actual fuel ratio content of at least 80% of that of unleaded gasoline having 86 octane. In some situations the catalyzed lower alcohols-water based fuels according to the invention provide an actual fuel ratio content greater than unleaded gasoline having 86 octane.

In accordance with the present invention the catalyzed lower alcohols-water based fuels contained from about 100 to 200 or 300 or greater ppm of the Group IIA or Group IIB oxide, which when blended with a fuel consisting predominately of monohydoxy alcohols having from about one to about four carbon atoms per molecule have been found to provide an internal combustion engine fuel utilization wherein the engines operate efficiently and demonstrate that the emissions of such blends of lower alcohol based fuels meet or exceed E.P.A. standards.

As shown by the following detail description of the invention through the data contained in the tables and as plotted on the various Figures, the catalyzed lower alcohols-water based fuels which can contain VMP surfactants and other additives clearly demonstrate the fuel according to the invention containing significant volumes of water can be satisfactorily utilized by internal combustion engines and that the off gasses of such engines utilizing the fuel according to the invention demonstrate that the emissions from such fuel meet or exceed E.P.A. standards.

BRIEF DESCRIPTION OF THE FIGURES

The graphic presentation of the data contained in Tables 1 through 6 are presented in FIGS. 1 through 6; however, the Figure number and Table numbers are not correlated. The FIGS. 1 through 6 show comparisons of a test blend of alcohol fuels as well as gasoline in the same internal combustion engine. When plotted the data, in order to be competitive with gasoline, should fall on the 45° line on the graphs.

DETAILED DESCRIPTION OF THE INVENTION

Figure 1:
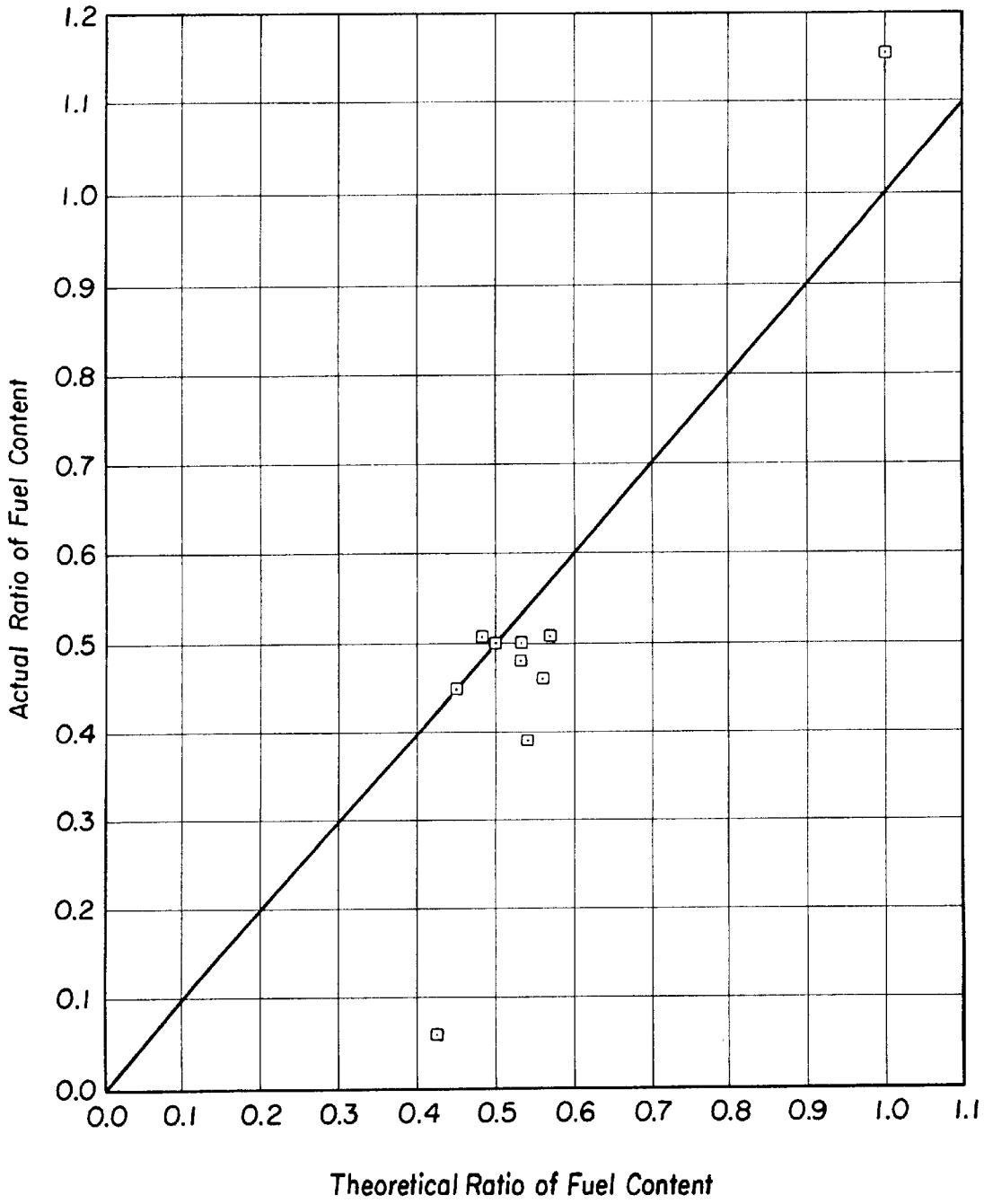
FIG. 1 presents a correlation of actual fuel ratio content to theoretical fuel ratio based on unleaded gasoline (86 octane)
Figure 2:
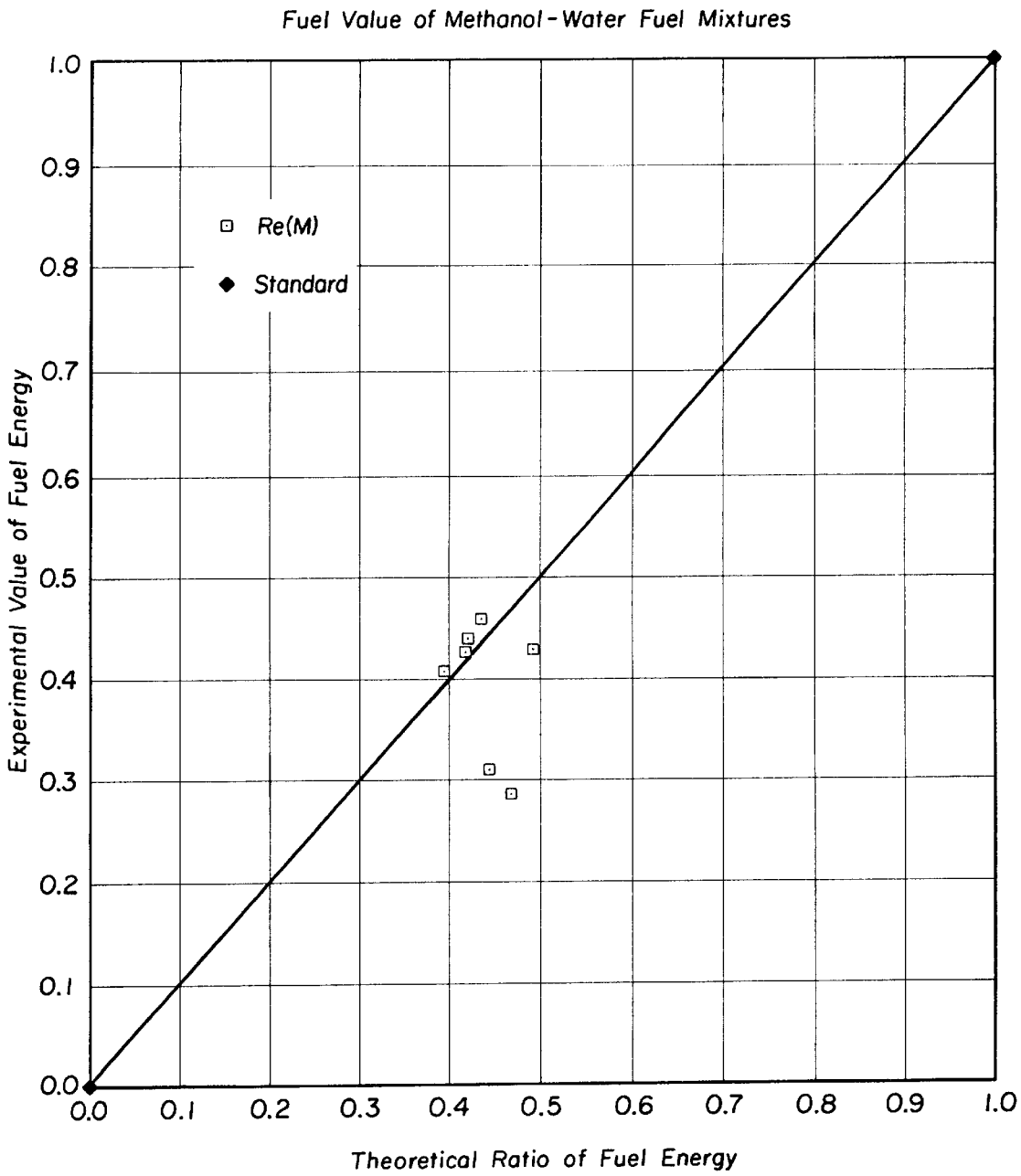
FIG. 2 presents the fuel value of methanol-water fuel mixtures with at least four points above the 45° angle or theoretical gasoline performance.
Figure 3:
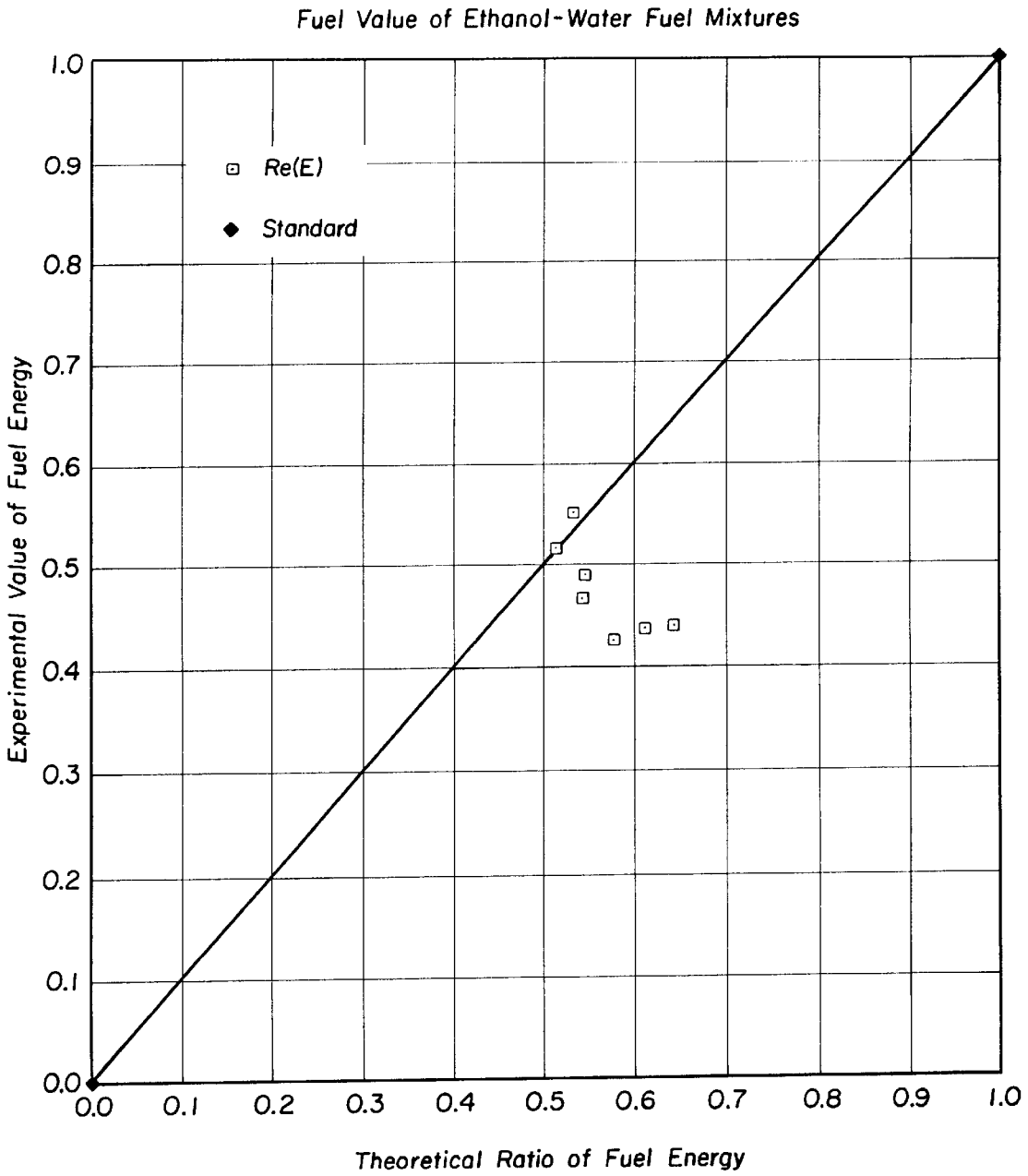
FIG. 3 presents the fuel value of ethanol-water blend with the same plot. i.e., theoretical ratio of fuel energy versus experimental value of the fuel energy.
Figure 4:
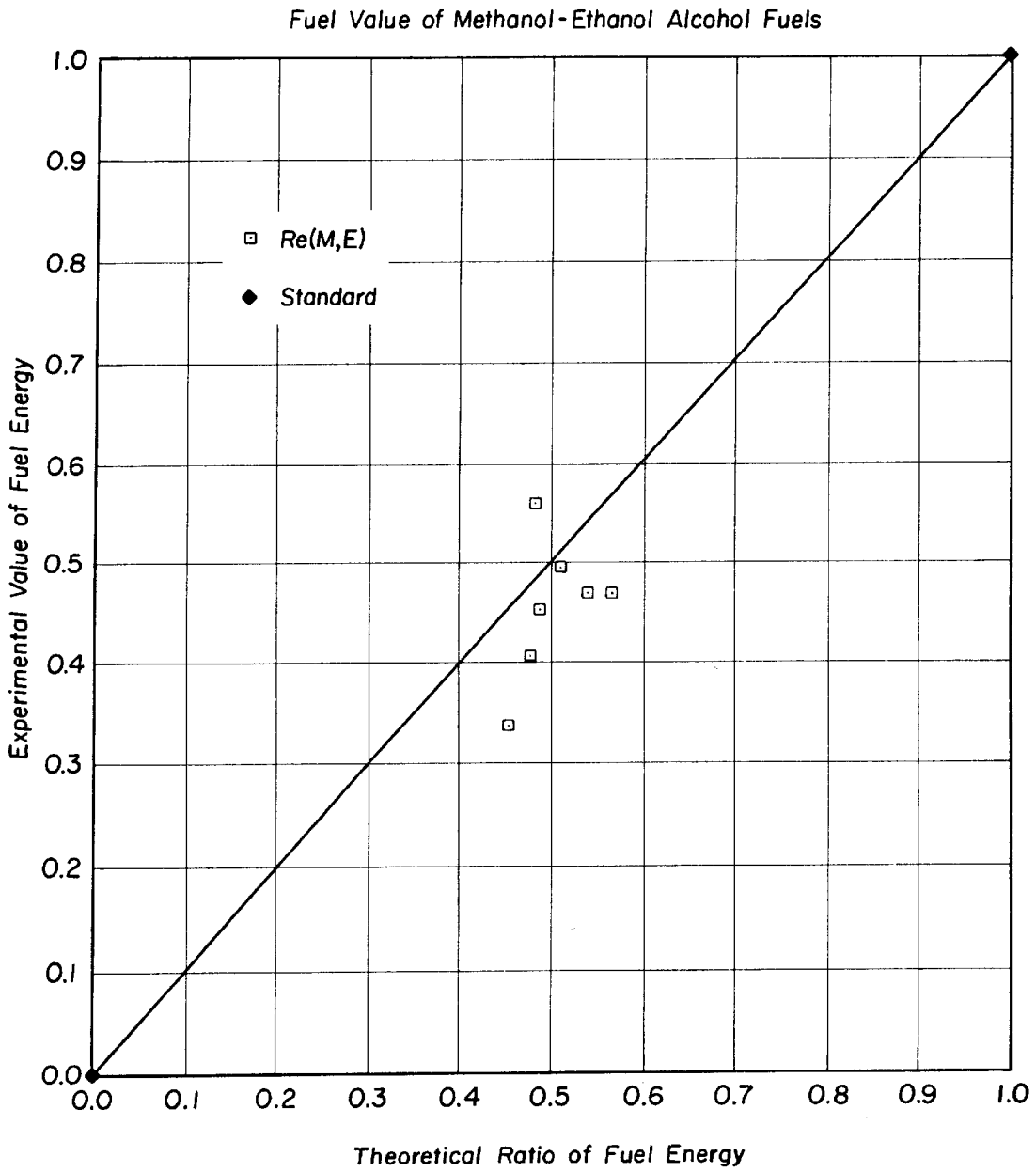
FIG. 4 presents the fuel value of methyl-ethanol alcohol blend.

One embodiment of the present invention is a catalyzed lower alcohol water based fuel system for use in internal combustion engines comprising a major amount of a monohydroxy alkanol having one up to about three or four carbon atoms; up to about twenty percent (20%) by volume water and an effective catalytic amount of a metal oxide, metal hydroxide selected from the group consisting of zinc oxide, zinc peroxide, zinc hydroxide, magnesium oxide, calcium oxide and the like. The catalyzed lower alcohols-based fuels and catalyzed lower alcohols-water based fuels in occurrence with the present invention have been found to provide internal combustion engines to operate efficiently and demonstrate that the emissions for such blends and lower alcohol-based fuels meet or exceed EPA standards.

Several thirty-two ounce samples of different alcohol blends of water and a fuel catalyst were tested in a Vanguard Briggs & Stratton, 14 Hp, V-twin generator. The generator had a constant load and a tachometer to monitor the rpm of the engine. Each fuel sample (32 oz) was timed for the total engine running time under conditions of constant load and rpm. During these tests gaseous emissions of hydrocarbons, carbon monoxide, carbon dioxide and oxygen were measured in the exhaust gasses from the engine.

The intents of these tests were to show: (1) that an internal combustion engine could be run on the alcohol fuels containing significant fractions of water, and (2) to demonstrate that the emissions from such fuels met or exceeded EPA standards. These tests were directed more at the energy content of the alcohol fuels tested, rather than at the data gathered on the gaseous emissions. However, the emissions levels are given in Tables 1 through Table 2 with the running time for each fuel mixture tested.

TABLE 1

EQUIPMENT: Vanguard Briggs & Stratton, 14 Hp, V-twin AMOUNT: 32 fluid ounces
TEST PRODUCT 1: Isopropyl Alcohol/Methanol/Ethanol
TEST PRODUCT 2: Methanol/Ethanol
TEST PRODUCT 3: Ethanol
TEST PRODUCT 4: Methanol

| HC1 | HC2 | HC3 | CO1 | CO2 | CO3 | CO²1 | CO²2 | CO²3 | O²1 | O²2 | O²3 | LENGTH |
|---|---|---|---|---|---|---|---|---|---|---|---|---|
| TEST 1: 0% Solution ($H_2O$) | | | | | | | | | | | | |
| 1267 | 2000 | na | .07 | .05 | na | 2.75 | 2.5 | na | 16.0 | 17.2 | na | 14:42 |
| 8 | 10 | 20 | 1.45 | 5.02 | 5.16 | 5.34 | 5.02 | 5.16 | 11.2 | 11.0 | 10.2 | 15:55 |
| 207 | 139 | 290 | 4.43 | 4.38 | 4.40 | 3.77 | 3.45 | 3.68 | 10.9 | 10.4 | 9.5 | 14:47 |
| 326 | 1625 | 2000 | .08 | .10 | .10 | 2.96 | 4.10 | 3.83 | 17.1 | 14.2 | 14.0 | 14:18 |
| TEST 2: 5% Solution | | | | | | | | | | | | |
| 2000 | 2000 | na | .05 | .04 | na | 2.36 | 2.41 | na | 17.6 | 17.7 | na | 15:35 |
| 15 | 10 | 14 | 1.0 | .93 | .90 | 5.26 | 5.33 | 5.20 | 11.0 | 11.0 | 10.6 | 15:56 |
| 22 | 11 | 13 | 3.83 | 3.44 | 3.41 | 4.43 | 4.52 | 4.71 | 10.6 | 10.0 | 10.9 | 14:37 |
| 0 | 0 | na | 1.42 | 3.12 | na | 5.47 | 4.85 | na | 12.5 | 10.3 | na | 9:40 |
| TEST 3: 10% Solution | | | | | | | | | | | | |
| 273 | na | na | .13 | na | na | 5.66 | na | na | 12.6 | na | na | 13:04 |
| 31 | 20 | 23 | .51 | .46 | .30 | 5.46 | 5.83 | 5.59 | 11.3 | 11.0 | 11.2 | 16:45 |
| 13 | 4 | 0 | 3.06 | 2.90 | 2.73 | 4.79 | 5.16 | 5.20 | 11.5 | 10.0 | 10.9 | 14:00 |
| 0 | 0 | 0 | 2.63 | 2.35 | 2.44 | 4.58 | 4.35 | 4.17 | 11.6 | 11.3 | 11.3 | 10:19 |
| TEST 4: 15% Solution | | | | | | | | | | | | |
| 109 | 692 | na | 3.90 | .27 | na | 5.73 | 1.73 | na | 7.6 | 10.2 | na | 9:00 |
| 24 | 31 | 48 | .14 | .13 | .08 | 4.86 | 5.73 | 5.24 | 12.8 | 11.3 | 12.2 | 18:50 |
| 0 | 0 | 0 | 1.92 | 1.43 | 1.53 | 5.09 | 5.15 | 5.46 | 11.9 | 11.8 | 11.9 | 16:18 |
| 0 | 0 | 0 | .56 | .65 | .61 | 3.58 | 4.22 | 4.22 | 14.8 | 13.9 | 13.7 | 14:10 |
| TEST 5: 20% Solution | | | | | | | | | | | | |
| 52 | 94 | na | 3.09 | 2.76 | na | 5.84 | 5.50 | na | 8.1 | 9.4 | na | 9:27 |
| 339 | 54 | 53 | .12 | 2.30 | 2.59 | 4.58 | 5.26 | 6.33 | 13.1 | 9.9 | 7.9 | 11:18 |
| 0 | 0 | 0 | .82 | .52 | .48 | 5.68 | 5.89 | 5.96 | 11.9 | 11.9 | 11.4 | 17:08 |
| 0 | 0 | 0 | .64 | .64 | .63 | 3.50 | 4.36 | 4.35 | 15.5 | 13.5 | 13.5 | 13:43 |
| TEST 6: 20% Solution, 5% VMP | | | | | | | | | | | | |
| na | na | na | na | na | na | na | na | na | na | na | na | na |
| 63 | 65 | 59 | 1.72 | 1.83 | 1.67 | 4.29 | 4.60 | 4.43 | 11.8 | 11.0 | 11.5 | 13:52 |
| 0 | 0 | 0 | .67 | .76 | .82 | 5.64 | 5.14 | 5.80 | 12.1 | 12.4 | 11.9 | 18:21 |
| 0 | 0 | 0 | .49 | .39 | .36 | 3.73 | 4.65 | 5.0 | 14.8 | 13.4 | 12.5 | 14:55 |
| TEST 7: 20% Solution, 7.5% VMP | | | | | | | | | | | | |
| na | na | na | na | na | na | na | na | na | na | na | na | na |
| 52 | 63 | 57 | 1.64 | 1.91 | 1.91 | 4.18 | 4.95 | 5.08 | 12.2 | 10.4 | 10.4 | 15:00 |
| 0 | 0 | 0 | 1.11 | 1.12 | 1.13 | 5.13 | 5.74 | 5.66 | 12.5 | 11.4 | 11.4 | 15:44 |
| 0 | 0 | 0 | .39 | .30 | .32 | 4.64 | 4.49 | 4.33 | 13.6 | 13.6 | 13.6 | 15:15 |

TABLE 2

EQUIPMENT: Vanguard Briggs & Stratton, 14 Hp, V-twin
AMOUNT: 32 fluid ounces

TEST PRODUCT 5: 100% Gasoline, 87 Octane, Texaco
TEST PRODUCT 6: 70% Ethanol, 15% Acetone, 15% Water, EMP
TEST PRODUCT 7: 65% Ethanol, 15% Water, 15% Acetone, 5% VMP, EMP/Naphthalene
TEST PRODUCT 8: 65% Ethanol, 15% Acetone, 15% Water, 5% VMP, 3 Teaspoons
TEST PRODUCT 9: 65% Ethanol, 15% Acetone, 15% Water, 5% VMP, EMP
TEST PRODUCT 10: 62.5% Ethanol, 15% Acetone, 15% Water, 7.5% VMP, EMP
TEST PRODUCT 11: 100% Ethanol, Trace EMP

TEST 1: BASELINE (3 TESTS ON ANALYZER)

| HC1 | HC2 | HC3 | CO1 | CO2 | CO3 | CO²1 | CO²2 | CO²3 | O²1 | O²2 | O²3 | LENGTH |
|---|---|---|---|---|---|---|---|---|---|---|---|---|
| 0.00 | 0.00 | 0.00 | .26 | .23 | .18 | 4.72 | 4.82 | 4.55 | 14.6 | 13.6 | 14.1 | 33:10 |
| 0.00 | 0.00 | 0.00 | .26 | .09 | .07 | 5.05 | 5.12 | 4.81 | 13.6 | 13.3 | 15.4 | 22:02 |
| 27 | 10 | 14 | 2.10 | 1.83 | 2.19 | 4.59 | 3.78 | 4.62 | 12.3 | 13.6 | 11.4 | 18:06 |
| 151 | 125 | 136 | 3.91 | 4.25 | 4.23 | 3.35 | 4.19 | 3.89 | 12.7 | 11.3 | 10.7 | 14:35 |
| 49 | 17 | 0.00 | 3.59 | 3.71 | .09 | 3.81 | 3.88 | 4.88 | 12.2 | 11.8 | 13.9 | 16:45 |

TABLE 2-continued

| EQUIPMENT: Vanguard Briggs & Stratton, 14 Hp, V-twin AMOUNT: 32 fluid ounces | | | | | | | | | | | | |
|---|---|---|---|---|---|---|---|---|---|---|---|---|
| 0.00 | 0.00 | 0.00 | 3.23 | 2.62 | 2.82 | 3.14 | 4.08 | 3.93 | 13.5 | 12.6 | 12.7 | 16:50 |
| 0.00 | 0.00 | 0.00 | .16 | .13 | .19 | 5.02 | 5.28 | 5.05 | 13.2 | 13.3 | 13.4 | 23:20 |

TABLE 3

COMPARISON OF DIFFERENT FUELS FOR INTERNAL COMBUSTION ENGINES

| Fuel Type (formula) | Heat of Combustion (HC) (kj/kg) | Density ($kg/m^3$) | Energy in 32 fl. oz* (kj) |
|---|---|---|---|
| Gasoline ($C_7H_{10.7}$) | −48,201 | 750 | $3.2869 \times 10^4$ |
| Diesel ($C_{14.4}H_{24.9}$) | −45,700 | 815 | $3.3864 \times 10^4$ |
| Methanol ($CH_3OH$) | −22,657 | 787 | $1.6212 \times 10^4$ |
| Ethanol ($C_2H_5OH$) | −29,676 | 783 | $2.1127 \times 10^4$ |
| Acetone ($(CH_3)_2CO$ | −15,078 | 790 | $1.0830 \times 10^4$ |
| Isopropyl Alcohol ($(CH_3)_2CHOH$) | −33,109 | 786 | $2.3650 \times 10^4$ |

Conversion Factors:
1.0 fluid oz. = 28.413 $cm^3$
$10^6$ $cm^3$ = 1.0 $m^3$
*This column was calculated by: (HC)*(Density)*(28.413)*(32)/($10^6$)

TABLE 4

Baseline Data For Texaco Regular 86 Octane Gasoline; and Texaco Regular with EMP Added*

| Average Running Time (minutes) | HC (ppm) | Average Exhaust Emissions CO (%) | $CO_2$ (%) |
|---|---|---|---|
| 38.81 (33.10 to 42.38) | 20 (0 to 66) | 0.55 (0.18 to 1.02) | 4.16 (1.02 to 4.96) |
| 48.94* (47.24 to 50.15) | 25* (1 to 108)* | 0.72* (0.38 to 0.90)* | 3.90* (3.0 to 4.96)* |

FUEL VALUE ASSESSMENT

The last column of Table 1 is labeled (LENGTH). This column represents the length of time that the test engine ran on each particular fuel blend. The data are listed as minutes and seconds (i.e., 14:42 represents 14 minutes and 42 seconds). The alcohol fuel blends contained: isopropyl alcohol, methanol, ethanol, water, acetone, VMP, and the commercial catalyst EMP™. EMP™ is EnviroMax Plus which is formulated by blending together by weight 40% naphthalene crystals and 60% powdered zinc oxide (particle diameter<1 micron). Add just enough methanol to make a smooth paste. Add 250 grams of this naphthalene-zinc oxide paste to 32 gallons of solvent mixture. It had been hypothesized that the oxides, peroxides and hydroxides of the Group IIA and Group IIB metals of the Periodic Table would be good catalysts to use with hydrocarbon fuels to reduce gaseous, tailpipe emissions.

In order to test this hypothesis a sample of zinc hydroxide was obtained, along with samples of magnesium peroxide, calcium peroxide, strontium peroxide, and barium peroxide. Earlier tests with zinc peroxide had shown that the peroxides were preferred form of these potential catalysts; because the metal peroxides can supply additional oxygen for the combustion process within the cylinder of the engine. The more stable, single oxide form of these metals can also act as an oxygen supply, but the available oxygen in the case of the oxide is only one half that of the peroxide. Similarly, the hydroxides of these metals can supply the same amount of oxygen as the metal oxide. However, the hydroxides are attractive because of their lower specific gravity versus that of the oxides. Typically, the smaller the specific gravity of the mineral, the greater will be the amount which can be suspended in the liquid fuel.

Of the Group IIA and Group IIB elements that were tested, the peroxides of zinc, calcium, and strontium were found to be the most effective. Zinc oxide and zinc hydroxide also performed well. However, the other Group IIA and Group IIB elements were either too toxic to be used or too ineffective to be considered as good fuel catalysts. The rejected elements included: beryllium (toxic), magnesium (ineffective), cadmium (toxic), barium (ineffective), mercury (toxic) and radium (toxic).

For emission testing, the oxygen rich minerals of Group II elements were suspended in several solvents and the suspension was then added directly to the liquid hydrocarbon fuel. The solvents were blends of ethanol, methanol and VM&P (varnish makers and painters solvent). Concentrations of the metals suspended in the solvents ranged from 500 to 5 ppm by weight. However, the tests also indicated that the mineral oxides could be added directly to the liquid fuel without solvents and still be active catalysts. Finally, the tests also indicated that combinations of the metal oxides could be used. Thus calcium peroxide, which was found to be most effective for the reduction of carbon dioxide, also worked when blended with the zinc oxides.

The solvent mixture contains 5% methanol, 10% ethanol and 85% VMP by volume. This suspension or solution of solvents is filtered to remove filterable particulate and the filtrate is bottled as the EMP product. In addition other catalyst such as zinc peroxide has been found to very effective in use with fuel blends, gasoline, diesel and the like in increasing performance and promoting a cleaner burn. This catalyst product (EZP) is made the same way that EMP is made, except that 2 to 4 grams of zinc peroxide is added to 1 kilogram (32 fluid oz.) of the EMP paste, and then the new paste is added to the solvent mixture. These catalyst are present in the inventive fuel blends in amounts of from about 5 to 10 ppm to about 300 ppm or greater, limited only by separation from suspension. As a baseline these fuels were compared with a typical consumer gasoline. Thirty-two fluid ounces of this gasoline were also run in the test engine at the same rpm and load as used for the alcohol blends, and its running time was recorded. In order to make a valid comparison of these radically different fuels, the energy content (per 32 fluid oz. Volume) of each pure fuel ingredient was estimated from its heat of combustion value. These values are shown in the attached Table 3 along with the pure component's density and chemical formula.

Figure 5:
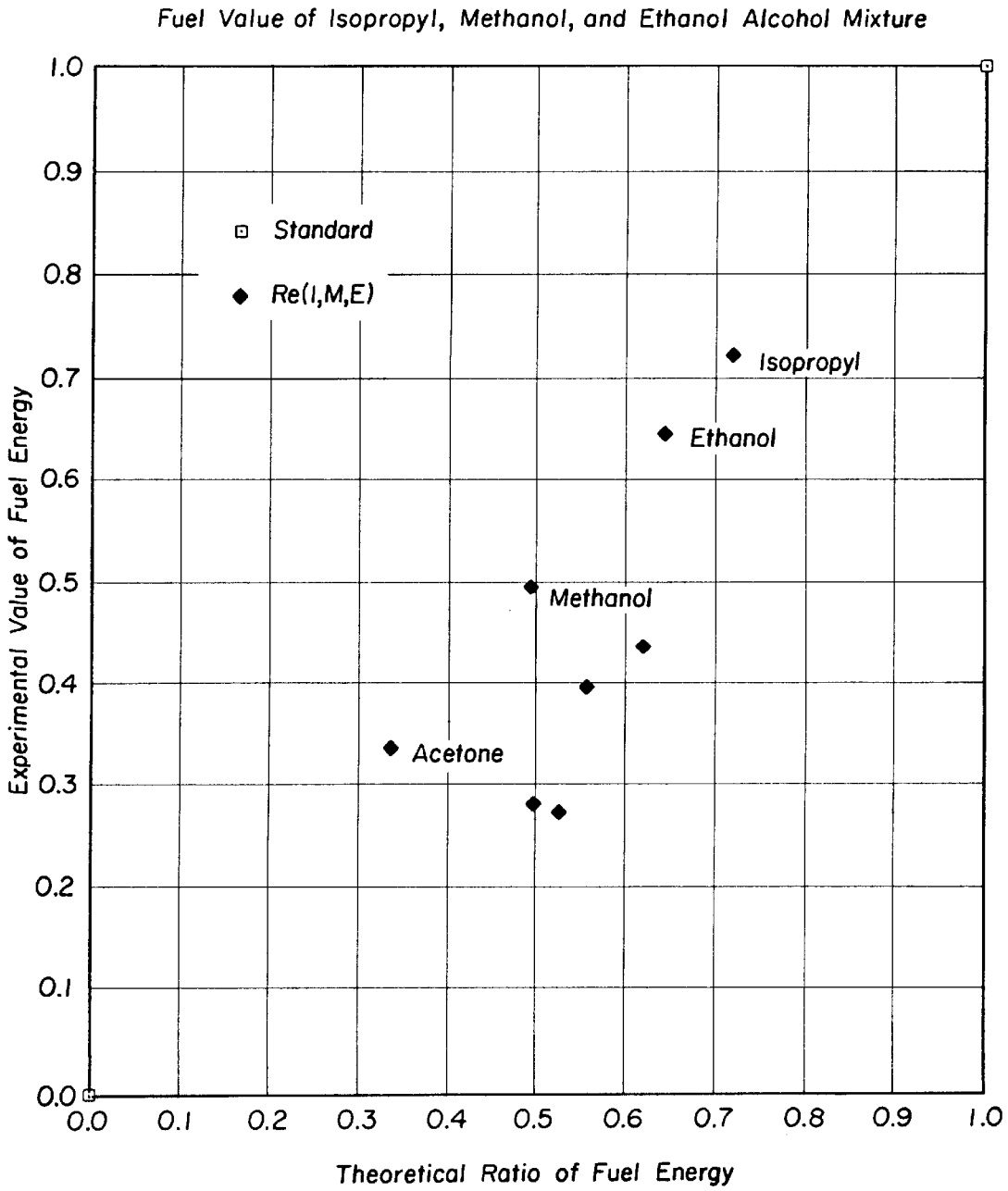
FIG. 5 presents the fuel value for isopropyl, methanol and ethanol alcohol mixture.
Figure 6:
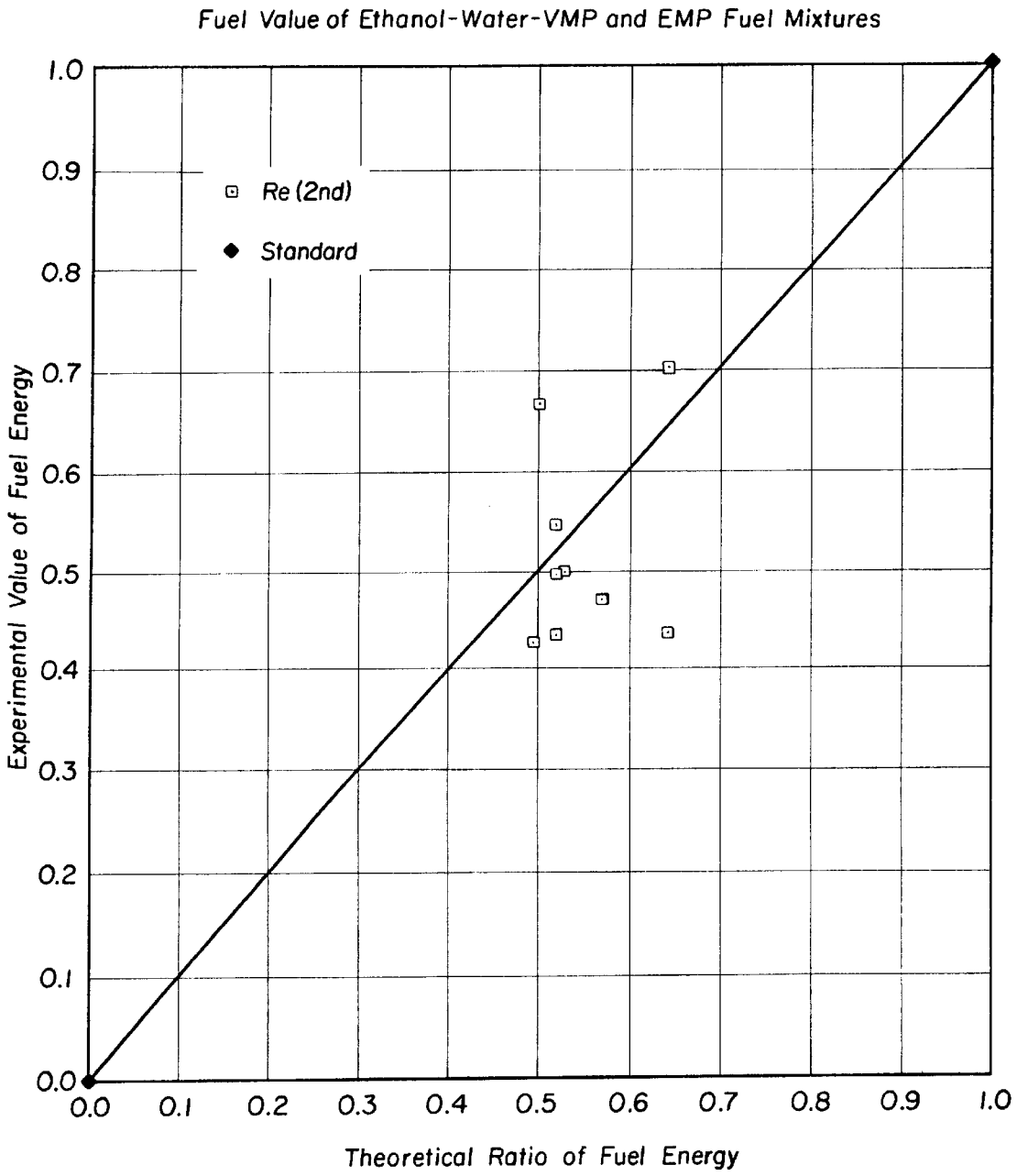
FIG. 6 presents the fuel value of ethanol-water-VMP and EMP fuel mixtures.

The VMP component was taken to be diesel rather than gasoline. By using the last column in Table 3, it is possible to predict the potential energy content for any fuel blend containing known volume fractions of the listed pure components. For example, a fuel blend containing one third each of isopropyl alcohol, methanol and ethanol, could conceivably contain one third of the sum of $[(2.3650+1.6212+2.1127)\times10^4]$ kj of energy. By dividing the energy content of this fuel blend by that of the thirty-two fluid ounces of the standard gasoline, a theoretical ratio for the running time expected for the fuel mixture can be obtained. This theoretical ratio can be compared to the experimental ratio of running times measured during the experiments. These comparisons are shown in the graphs of FIGS. 1 through 6. If the test blend of the alcohol fuel performs as well as the gasoline in the engine, then the data should fall on the 45° line on the graphs. When the plotted data fall below the 45°, then the fuel is less satisfactory than gasoline. If, however, the plot of the data falls above the 45° line then the fuel blend is performing better than gasoline. Typically one would expect more points to be below the 45-degree line than above it. This behavior was observed for the one third mixture of isopropyl, methyl and ethyl alcohol (FIG. 5). The methyl-ethyl alcohol blend (FIG. 4) had one point only above the line. The ethanol blend (FIG. 3) had two points potentially above the line, while the methanol blends (FIG. 2) had four points above the line. A second run of different fuel blends, which contained small amounts of VMP (Varnish Makers and Painters) (petroleum spirits, petroleum thinner) also had three points significantly above the 45-degree line. VM&P is a suitable solvent for use with present invention. VMP is aliphatic hydrocarbon solvent, more preferably an aliphatic petroleum distillate compound. The most preferred aliphatic petroleum distillate is VM&P Naphtha, which emits relatively few volatile organic compounds (VOC) when burned, blends well with the other components of the fuel, and is relatively inexpensive. Other aliphatic hydrocarbon solvents may also be used. VM&P Naphtha is particularly preferred in inventive fuel compositions designed for use in internal combustion and hobby engines and 2-cycle and 4-cycle motorcycles engines for which a fuel having high BTU's is more desirable (VM&P Naphtha has about 22,400 BTU's). The concentration of aliphatic petroleum distillates may range from about 1 w/w % to about 90 w/w %, with the more preferred ranges depending upon the type of engine used. These data suggest that while the energy density of the alcohol blends of fuel are much less than that of a gasoline, they are sufficient to run the internal combustion engine and on a comparative basis provide more energy. With gasoline fuels, part of this carbon is unburned, as evidenced by the production of hydrocarbon and carbon monoxide constituents in the emissions. The water in the alcohol-based fuels, however, helps burn these constituents more completely through the water shift reaction and by a leaning of the fuel-oxygen ratio. Both of these actions are facilitated by the fuel catalyst, EMP. Hence, some of these alcohol blends have the ability to outperform gasoline as shown by the data.

These data, while only preliminary, indicate that internal combustion engines can be run on alcohol fuels containing significant levels of water and the EMP-EZP catalyst. This shows that a fuel system based on renewable carbon sources is available, and although the energy densities of these fuels are less than gasoline, their combustion is more complete making them more environmentally friendly.

ALCOHOL-WATER BASED FUELS WITH EMP (EMISSIONS)

A Vanguard Briggs & Stratton, 14 Hp, V-twin generator was used to test the performance of several different alcohol-water based fuels with a soluble catalyst, EMP. The generator had a constant load and was fitted with a tachometer to monitor the rpm of the engine. In each test, 32 fluid ounces of the fuel blend being tested was supplied to the fuel tank of the generator. The engine was started, and the following parameters were measured while the engine ran under a constant load and rpm: (1) exhaust gas emissions for hydrocarbons (HC ppm), carbon monoxide (CO %), and carbon dioxide ($CO_2$ %), and (2) the total engine running time in minutes for the thirty-two (32) fluid ounces of fuel.

GOALS OF THE STUDY

The intent of these tests were to show: (A) that an internal combustion engine could be run successfully on alcohol fuels which contained significant fractions of water, and (B) to demonstrate that the exhaust emissions produced by these fuels with the catalyst are comparatively low. Finally, an effort was made to compare both the theoretical energy content of the fuel to that of a commercial, unleaded, regular 86 octane gasoline. Based on the design of the experiment, it was hypothesized that the total running time of the engine would be representative of the energy content of the fuel; i.e. 32 fluid ounces of gasoline was expected to run longer than 32 fluid ounces of methanol because the gasoline has a greater theoretical energy density.

TABLE 4

Baseline Data For Texaco Regular 86 Octane Gasoline; and Texaco Regular with EMP Added*

| Average Running Time (minutes) | HC (ppm) | Average Exhaust Emissions CO (%) | $CO_2$ (%) |
|---|---|---|---|
| 38.81 | 20 | 0.55 | 4.16 |
| (33.10 to 42.38) | (0 to 66) | (0.18 to 1.02) | (1.02 to 4.96) |
| 48.94* | 25* | 0.72* | 3.90* |
| (47.24 to 50.15) | (1 to 108)* | (0.38 to 0.90)* | (3.0 to 4.96)* |

SUMMARY OF THE DATA COLLECTED

Texaco unleaded, regular 86 octane gasoline, was chosen as the baseline fuel for this series of tests. Each fuel was run in the generator at least four times in order to establish the repeatability of the data collection protocol. The data obtained are given in Table 4. The first row of data are just the gasoline; the second row had the catalyst, EMP added. The numbers in parentheses represent the range of values which were recorded for the variable being measured. In general it was found that the type of gasoline being used to establish a baseline did not have an effect as long as an 86 octane grade was used for the test. Also, the generator engine was run with an excess of air during all tests run. The use of excess air causes the $CO_2$ levels in the exhaust emissions to fall below the expected stoichiometric levels for the exhaust gas analyses. This also dilutes the other two gaseous components, (HC and CO) being monitored.

Three different alcohols were tested as potential fuel blends. The three were; methanol, ethanol and isopropyl alcohol. Since the initial tests indicated that isopropyl alcohol did not perform well, isopropyl was dropped from the test protocol. Tables 5 and 6 represent a summary of some of the experimental data collected respectively for ethanol and methanol and catalyzed ethanol, methanol and water blends.

TABLE 5

| Data for Ethanol-Water Fuel Blends With the Additive EMP | | | | | |
|---|---|---|---|---|---|
| Running Time | Theoretical | Actual | Exhaust Emissions | | |
| (Minutes) | Ratio | Ratio | HC (ppm) | CO (%) | $CO_2$ (%) |
| Fuel Blend: 24 fl oz Ethanol (75 v/o), 6.4 fl oz Water (20 v/o), 1.6 fl oz (5 v/o) VM&P, & EMP | | | | | |
| 25.00 | 0.57 | 0.51 | 64 | 1.46 | 3.86 |
| Fuel Blend: 25.6 fl oz Ethanol (80 v/o), 6.4 fl oz Water (20 v/o), & EMP | | | | | |
| 23.10 | 0.56 | 0.46 | 119 | 1.41 | 4.03 |

The data in Table 5 suggest that although the two water-ethanol blends ran in the generator engine, their overall performance was not quite as good as that for the unleaded, regular 86 octane gasoline. The theoretical ratio of the energy content of the alcohol blend to the energy content in gasoline was only 0.57 to 0.56. This means that the volumetric energy content for these ethanol blends is only 60% that of gasoline. Hence, a fuel tank would need to be roughly 40% bigger if ethanol fuels were to have the same travel range as a hydrocarbon based gasoline fuel. For stationary engines this may not be a serious problem.

Considering the scatter in data, the exhaust emissions for the alcohol fuel blends appear to be equivalent or slightly higher than for those of the gasoline based fuel. Hence, it can be concluded that the use of ethanol based fuels of the same formulation as those studied in this test would neither help nor harm the environment.

Table 6 shows the data which were obtained using a series of methanol-water based fuels. As with the gasoline, the methanol data were taken for both the pure alcohol alone and for methanol containing the additive EMP.

TABLE 6

| Data for Methanol-Water Based Fuels With the Additive EMP | | | | | |
|---|---|---|---|---|---|
| Running Time | Theoretical | Actual | Exhaust Emissions | | |
| (Minutes) | Ratio | Ratio | HC (ppm) | CO (%) | $CO_2$ (%) |
| A. Fuel Blend: Pure Methanol (100 v/o) | | | | | |
| 19.50 | 0.53 | 0.50 | 42 | 1.55 | 2.83 |
| B. Fuel Blend: Methanol (100 v/o) & EMP | | | | | |
| 23.45 | 0.53 | 0.48 | 0 | 0.15 | 3.90 |
| C. Fuel Blend: Methanol 30.4 fl oz (95 v/o), Water 1.6 fl oz (5 v/o) & EMP | | | | | |
| 24.40 | 0.50 | 0.50 | 0 | 0.29 | 3.98 |
| D. Fuel Blend: Methanol 28.8 fl oz (90 v/o), Water 3.2 fl oz (10 v/o) & EMP | | | | | |
| 25.10 | 0.48 | 0.51 | 3 | 0.06 | 4.18 |
| E. Fuel Blend: Methanol 27.2 fl oz (85 v/o), Water 4.8 fl oz (15 v/o) & EMP | | | | | |
| 22.09 | 0.45 | 0.45 | 8 | 0.05 | 3.68 |
| F. Fuel Blend: Methanol 25.6 fl oz (80 v/o), Water 6.4 fl oz (20 v/o) & EMP | | | | | |
| 3.14 | 0.43 | 0.06 | 182 | 0.08 | 3.28 |
| G. Fuel Blend: Methanol 19.2 fl oz. Ethanol 8 fl oz, Water 3.2 fl oz, VM&P 1.6 fl oz & EMP | | | | | |
| 19.20 | 0.54 | 0.39 | 69.4 | 1.81 | 3.68 |

Like the ethanol data in Table 5, the methanol data in Table 6 support the concept that methanol fuel mixture can be used successfully to run internal combustion engines. Moreover, the fuel additive EMP was found to promote the combustion of those methanol-water blends which were tested. However, there was an upper limit near 20% water by volume where the engine performance was found to be seriously compromised. The methanol-water blends, like the ethanol blends, were also found to have lower energy densities than the liquid hydrocarbon gasoline. With methanol, nearly twice the volume of fuel was required for the same range or fuel value measured for the gasoline. However, the gaseous emissions from the methanol fuels were found to be better than those for the regular 86 octane gasolines; at least when EMP was added. The data in Table 6 would further appear to support the hypothesis that methanol and EMP form a synergistic combination with respect to combustion. This synergistic effect, perhaps aided by the presence of water, resulted in a superior performance of the methanol mixture which contained the ten volume percent water; fuel blend D in Table 6. This observation is supported by the fact that the actual running time ratio was found to be larger than predicted, or theoretical, running time ratio; i.e., 0.51>0.48. Finally, for run (G), in Table 6, a combination of methanol and ethanol with water and VM&P solvent performed adequately in the engine; although the emission levels increased.

The correlation for the theoretical and actual running times for the fuels are shown in FIG. 1. In this figure the data are expected to fall on the 45° line which would imply that the fuel's energy is being utilized in the engine like gasoline. Data points which fall below the 45° line indicate that the energy content of the fuel blend is not being well utilized. Conversely, points above the 45° line indicate that the fuel's performance in the engine is better than that of gasoline. The data indicates that the gasoline with EMP performed better than gasoline alone, and that one of the methanol blends (D) also did better than expected. Such superior performances are attributed to the use of the EMP additive, and to its ability to shift carbon deposits to gaseous CO which is subsequently oxidized to $CO_2$; or more complete combustion. It may also be that the methanol, unlike ethanol or propanol, assists in the conversion of the pyrolyic carbon by helping to solvate it.

These data indicate that internal combustion engines can indeed be run on alcohol fuels containing significant levels of water; and a catalyst. This shows that a fuel system based on renewable carbon resources can be developed. And, although the energy densities of the alcohol fuels tested in this study are significantly lower than gasoline, their combustion can be much more complete, which potentially renders them much more environmentally friendly.

Although the present invention and its advantages have been described in detail, it should be understood that various changes, substitutions and alterations can be made herein without departing from the spirit and scope of the invention as defined by the appended claims.

We claim:

1. Catalyzed lower alcohols-water based fuels for use in internal combustion engines, comprising a major amount of at least one monohydroxy alkanol, having from one to about three carbon atoms per molecule, about 5% to about 20% by volume water; and from about 5 ppm to about 300 ppm based on the alcohols-water fuels of a catalyst selected from the group consisting of zinc oxide, zinc peroxide, zinc hydroxide, strontium oxide, strontium peroxide, calcium oxide, calcium hydroxide and calcium peroxide.

2. The catalyzed lower alcohols-water based fuels according to claim 1 wherein the monohydroxy alkanol is methanol.

3. The catalyzed lower alcohols-water based fuels according to claim 1 wherein the monohydroxy alkanol is ethanol.

4. The catalyzed lower alcohols-water based fuels according to claim 1 wherein the major amount of monohydroxy alkanols, having from one to about three carbon atoms is comprised of a mixture of alcohols.

5. The catalyzed lower alcohols-water based fuels according to claim 4 wherein the alcohols mixture is comprised of methanol and ethanol.

6. The catalyzed lower alcohols-water based fuels according to claim 1 wherein from about one to ten percent by volume is comprised of VMP.

7. The catalyzed lower alcohols-water based fuels according to claim 1 wherein the catalyst is comprised of zinc oxide.

8. The catalyzed lower alcohols-water based fuels according to claim 1 wherein the catalyst is comprised of zinc peroxide.

9. The catalyzed lower alcohols-water based fuels according to claim 1 wherein the catalyst is comprised of zinc hydroxide.

10. The catalyzed lower alcohols-water based fuels according to claim 1 wherein the catalyst is comprised of calcium oxide.

11. The catalyzed lower alcohols-water based fuels according to claim 1 wherein the catalyst is comprised of calcium peroxide.

12. The catalyzed lower alcohols-water based fuels according to claim 1 wherein the catalyst is a mixture of at least two of the group consisting of zinc oxide, zinc peroxide, zinc hydroxide, strontium oxide, strontium peroxide, calcium oxide, calcium hydroxide and calcium peroxide.

13. The catalyzed lower alcohols-water based fuels according to claim 12 wherein the mixture is comprised of at least two of calcium oxide, calcium peroxide, zinc peroxide, zinc oxide and zinc hydroxide.

14. The catalyzed lower alcohols-water based fuels according to claim 1 wherein water comprises from ten to about twenty percent by volume of the fuel.

15. The catalyzed lower alcohols-water based fuels according to claim 1 wherein at least monohydroxy alkanol comprises from about 70% or greater by volume of the fuels.

16. The catalyzed lower alcohols-water based fuels according to claim 1 wherein the fuels contain sufficient energy to provide at least about 80% of actual fuel ratio content of 86 octane gasoline.

17. The catalyzed lower alcohols-water based fuels according to claim 11 wherein the fuels provide at least about 80% or greater of the actual fuel ratio content of 86 octane gasoline.

18. The catalyzed lower alcohols-water based fuels according to claim 1 wherein the fuels provide at least equal to or greater actual fuel ratio content than that of 86 octane gasoline.

* * * * *